United States Patent [19]

Gruia

[11] Patent Number: 4,954,242

[45] Date of Patent: Sep. 4, 1990

[54] PROCESS FOR REFRACTORY COMPOUND REMOVAL IN A HYDROCRACKER RECYCLE LIQUID

[75] Inventor: Adrian J. Gruia, Lake Bluff, Ill.

[73] Assignee: UOP, Des Plaines, Ill.

[21] Appl. No.: 381,903

[22] Filed: Jul. 19, 1989

[51] Int. Cl.[5] ..... C10G 67/06; C10G 25/03

[52] U.S. Cl. ..... 208/99; 208/48 R; 208/111; 208/310 R; 208/310 Z; 208/100; 208/102

[58] Field of Search ..... 208/99, 108, 48 R, 111, 208/310 R

[56] References Cited

U.S. PATENT DOCUMENTS

| | | | |
|---|---|---|---|
| 3,172,835 | 3/1965 | Scott, Jr. | 208/58 |
| 3,619,407 | 11/1971 | Attane | 208/48 R |
| 4,447,315 | 5/1984 | Lamb et al. | 208/99 |
| 4,618,412 | 10/1986 | Hudson et al. | 208/59 |
| 4,698,146 | 10/1987 | Gruia | 208/86 |
| 4,775,460 | 10/1988 | Reno | 208/108 |

*Primary Examiner*—Helane Myers

*Attorney, Agent, or Firm*—Thomas K. McBride; John G. Tolomei; John G. Cutts, Jr.

[57] ABSTRACT

A catalytic hydrocracking process which comprises: (a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to convert a substantial portion of the feedstock to lower boiling hydrocarbon products; (b) partially condensing the hydrocarbon effluent from the hydrocracking zone to produce a gaseous hydrocarbon stream comprising hydrogen, and an unconverted hydrocarbon stream having components boiling above about 400° F. (204° C.) and comprising trace quantities of 11+ ring heavy polynuclear aromatic compounds; (c) partially condensing at least a portion of the gaseous hydrocarbon stream comprising hydrogen recovered in step (b) to produce a hydrogen-rich gaseous stream and a liquid stream comprising lower boiling hydrocarbon products; (d) contacting at least a portion of the unconverted hydrocarbon stream having components boiling above about 400° F. (204° C.) and comprising trace quantities of 11+ ring heavy polynuclear aromatic compounds recovered in step (b) with an adsorbent in an adsorption zone which selectively retains the 11+ ring heavy polynuclear aromatic compounds to produce an unconverted hydrocarbon stream having components boiling above about 400° F. (204° C.) and having a reduced concentration of 11+ ring heavy polynuclear aromatic compounds; (e) introducing at least a portion of the unconverted hydrocarbon stream having components boiling above about 400° F. (204° C.) and having a reduced concentration of 11+ ring heavy polynuclear aromatic compounds resulting from step (d) and the liquid stream recovered from step (c) into a separation zone to produce a stream of lower boiling hydrocarbon products and a stream of unconverted hydrocarbonaceous compounds boiling above about 400° F. (204° C.); and (f) recycling at least a portion of the stream of unconverted hydrocarbonaceous compounds boiling above about 400° F. (204° C.) recovered in step (e) and at least a portion of the unconverted hydrocarbon stream having components boiling above about 400° F. (204° C.) and having a reduced concentration of 11+ ring heavy polynuclear aromatic compounds resulting from step (d) to the hydrocracking zone as at least a portion of the liquid recycle stream.

12 Claims, 1 Drawing Sheet

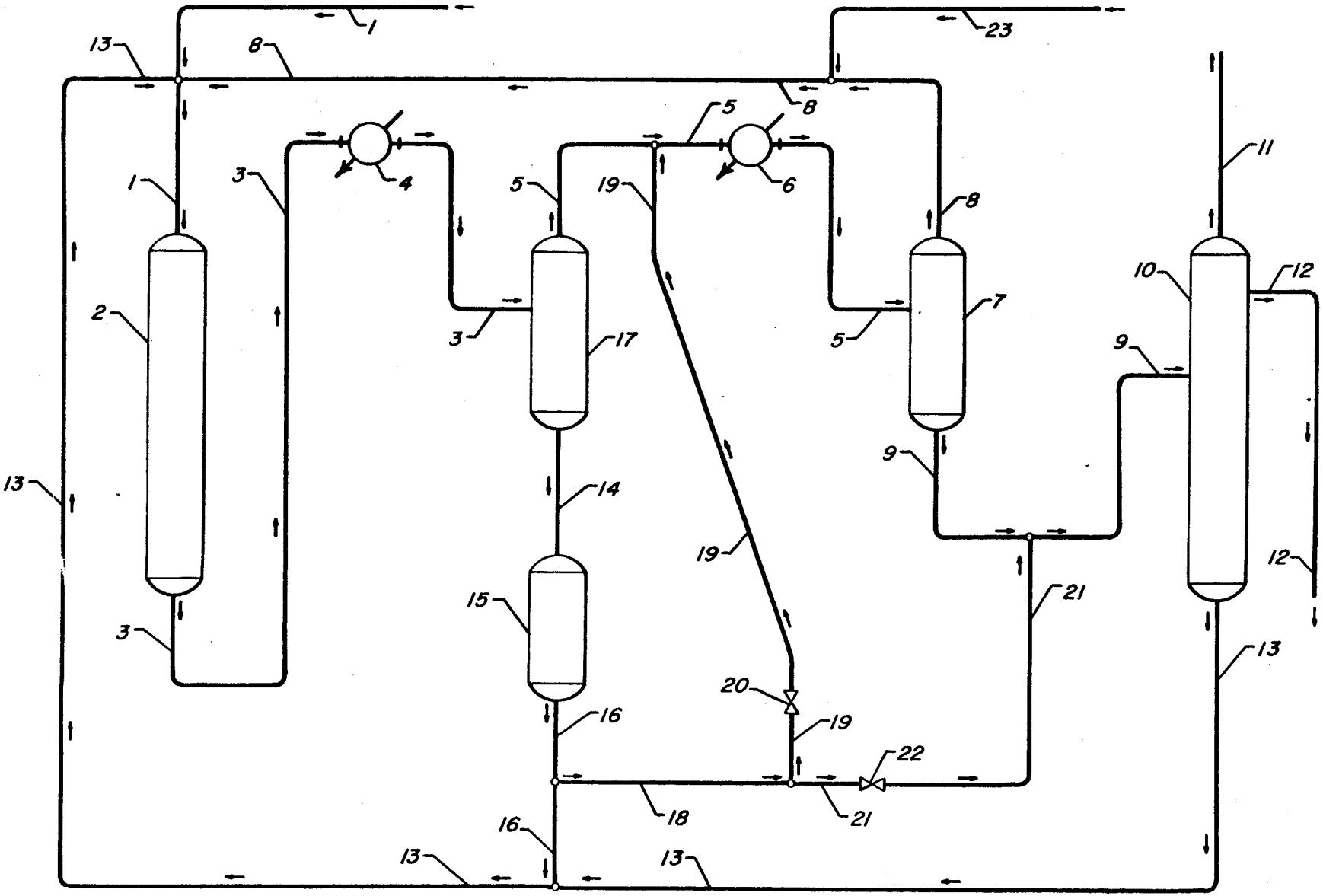
1
2
3
4
5
6
7
8
9
10
11
12
13
14
15
16
17
18
19
20
21
22
23

PROCESS FOR REFRACTORY COMPOUND REMOVAL IN A HYDROCRACKER RECYCLE LIQUID

BACKGROUND OF THE INVENTION

The field of art to which this invention pertains is the hydrocracking of a hydrocarbonaceous feedstock having a propensity to form 11+ ring heavy polynuclear aromatic compounds without excessively fouling the processing unit. The 11+ ring heavy polynuclear aromatic compounds are considered to be refractory in a hydrocracking process, are highly resistant to conversion in a hydrocracking reaction zone and are therefore undesirable components in the combined feed or recycle to a hydrocracking reaction zone. More specifically, the invention relates to a catalytic hydrocracking process which comprises: (a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to convert a substantial portion of the feedstock to lower boiling hydrocarbon products; (b) partially condensing the hydrocarbon effluent from the hydrocracking zone to produce a gaseous hydrocarbon stream comprising hydrogen, and an unconverted hydrocarbon stream having components boiling above about 400° F. (204° C.). and comprising trace quantities of 11+ ring heavy polynuclear aromatic compounds; (c) partially condensing at least a portion of the gaseous hydrocarbon stream comprising hydrogen recovered in step (b) to produce a hydrogen-rich gaseous stream and a liquid stream comprising lower boiling hydrocarbon products; (d) contacting at least a portion of the unconverted hydrocarbon stream having components boiling above about 400° F. (204° C.) and comprising trace quantities of 11+ ring heavy polynuclear aromatic compounds recovered in step (b) with an adsorbent in an adsorption zone which selectively retains the 11+ ring heavy polynuclear aromatic compounds to produce an unconverted hydrocarbon stream having components boiling above about 400° F. (204° C.) and having a reduced concentration of 11+ ring heavy polynuclear aromatic compounds; (e) introducing at least a portion of the unconverted hydrocarbon stream having components boiling above about 400° F. (204° C.) and having a reduced concentration of 11+ ring heavy polynuclear aromatic compounds resulting from step (d) and the liquid stream recovered from step (c) into a separation zone to produce a stream of lower boiling hydrocarbon products and a stream of unconverted hydrocarbonaceous compounds boiling above about 400° F. (204° C.); and (f) recycling at least a portion of the stream of unconverted hydrocarbonaceous compounds boiling above about 400° F. (204° C.) recovered in step (e) and at least a portion of the unconverted hydrocarbon stream having components boiling above about 400° F. (204° C.) and having a reduced concentration of 11+ring heavy polynuclear aromatic compounds resulting from step (d) to the hydrocracking zone as at least a portion of the liquid recycle stream.

INFORMATION DISCLOSURE

In U.S. Pat. No. 4,447,315 (Lamb et al), a method is disclosed for hydrocracking a hydrocarbon feedstock having a propensity to form polynuclear aromatic compounds which method includes contacting the hydrocarbon feedstock with a crystalline zeolite hydrocracking catalyst, contacting at least a portion of the resulting unconverted hydrocarbon oil containing polynuclear aromatic compounds with an adsorbent which selectively retains polynuclear aromatic compounds and recycling unconverted hydrocarbon oil having a reduced concentration of polynuclear aromatic compounds to the hydrocracking zone.

In U.S. Pat. No. 3,619,407 (Hendricks et al), a process is claimed to prevent fouling of the equipment in a hydrocracking process unit which comprises partially cooling the effluent from the hydrocracking zone to effect condensation of a minor proportion of the normally liquid hydrocarbons therein, thereby forming a polynuclear aromatic rich partial condensate and withdrawing a bleedstream of the partial condensate. The '407 patent acknowledges as prior art that the hereinabove mentioned fouling problem may also be solved by subjecting the recycle oil (the heavy portion of the hydrocracking zone effluent), or a substantial portion thereof, to atmospheric distillation or vacuum distillation to separate out a heavy bottom fraction containing polynuclear aromatic compounds.

In U.S. Pat. No. 4,698,146 (Gruia), a process is disclosed wherein a vacuum gas oil feed stream is prepared in a fractionation zone and converted in a hydrocracking zone. An unconverted vacuum gas oil stream containing polynuclear aromatic compounds is recovered from the effluent of the hydrocracking zone and introduced into the original feed preparation fractionation zone in order to remove and harvest the polynuclear aromatic compounds in a slop wax stream to prevent their recycle to the hydrocracking zone with the vacuum gas oil feed.

In U.S. Pat. No. 3,172,835 (Scott, Jr.), a process is disclosed wherein at least a portion of the recycle stream is hydrogenated to reduce the concentration of polynuclear aromatics therein.

In U.S. Pat. No. 4,618,412 (Hudson et al), a process is disclosed wherein at least a portion of the unconverted hydrocarbon oil found in a hydrocracking process and containing polynuclear aromatic compounds is contacted with an iron catalyst to hydrogenate and hydrocrack the polynuclear aromatic hydrocarbon compounds and recycle the unconverted hydrocarbon oil having a reduced concentration of polynuclear aromatic compounds to the hydrocracking zone. The '412 patent claims the use of a catalyst to hydrogenate and hydrocrack the recycle stream which catalyst contains elemental iron and one or more of an alkali or alkaline-earth metal, or compound thereof. The '412 patent teaches that this catalyst may also be supported, preferably, on an inorganic oxide support including, but not limited to, the oxides of aluminum, silicon, boron, phosphorus, titanium, zirconium, calcium, magnesium, barium, mixtures of these and other components, clays, such as bentonite, zeolites and other alumino-silicate materials, e.g., montmorillonite.

BRIEF SUMMARY OF THE INVENTION

The present invention is a catalytic hydrocracking process which minimizes the fouling of the process unit with 11+ ring heavy polynuclear aromatic compounds by means of partially condensing the hydrocarbon effluent from the hydrocracking zone to produce an unconverted hydrocarbon stream having components boiling above about 400° F. (204° C.) comprising trace quantities of 11+ ring heavy polynuclear aromatic compounds and contacting the unconverted hydrocarbon stream with an adsorbent which selectively retains the 11+ ring heavy polynuclear aromatic compounds before a portion of the unconverted hydrocarbon stream is recycled to the hydrocracking zone. Another portion of the unconverted hydrocarbon stream having a reduced concentration of 11+ ring heavy polynuclear aromatic compounds is introduced into a separation zone to produce a stream of unconverted hydrocarbonaceous compounds boiling above about 400° F. (204° C.) and at least a portion of which latter stream is recycled to the hydrocracking zone. These steps significantly minimize the introduction of the undesirable 11+ ring heavy polynuclear aromatic compounds into the hydrocracking zone.

One embodiment of the present invention relates to a catalytic hydrocracking process which comprises: (a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to convert a substantial portion of the feedstock to lower boiling hydrocarbon products; (b) partially condensing the hydrocarbon effluent from the hydrocracking zone to produce a gaseous hydrocarbon stream comprising hydrogen, and an unconverted hydrocarbon stream having components boiling above about 400° F. (204° C.) and comprising trace quantities of 11+ ring heavy polynuclear aromatic compounds; (c) partially condensing at least a portion of the gaseous hydrocarbon stream comprising hydrogen recovered in step (b) to produce a hydrogen-rich gaseous stream and a liquid stream comprising lower boiling hydrocarbon products; (d) contacting at least a portion of the unconverted hydrocarbon stream having components boiling above about 400° F. (204° C.) and comprising trace quantities of 11+ ring heavy polynuclear aromatic compounds recovered in step (b) with an adsorbent in an adsorption zone which selectively retains the 11+ ring heavy polynuclear aromatic compounds to produce an unconverted hydrocarbon stream having components boiling above about 400° F. (204° C.) and having a reduced concentration of 11+ ring heavy polynuclear aromatic compounds; (e) introducing at least a portion of the unconverted hydrocarbon stream having components boiling above about 400° F. (204° C.) and having a reduced concentration of 11+ ring heavy polynuclear aromatic compounds resulting from step (d) and the liquid stream recovered from step (c) into a separation zone to produce a stream of lower boiling hydrocarbon products and a stream of unconverted hydrocarbonaceous compounds boiling above about 400° F. (204° C.); and (f) recycling at least a portion of the stream of unconverted hydrocarbonaceous compounds boiling above about 400° F. (204° C.) recovered in step (e) and at least a portion of the unconverted hydrocarbon stream having components boiling above about 400° F. (204° C.) and having a reduced concentration of 11+ ring heavy polynuclear aromatic compounds resulting from step (d) to the hydrocracking zone as at least a portion of the liquid recycle stream.

Other embodiments of the present invention encompass further details such as types and descriptions of feedstocks, hydrocracking catalysts, adsorbents, and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The above described drawing is intended to be schematically illustrative of the present invention and not be a limitation thereof.

DETAILED DESCRIPTION OF THE INVENTION

It has been discovered that a total recycle of unconverted oil can be maintained for extended periods in the above described hydrocracking process unit without encountering the above noted fouling or precipitation problems.

It has also been discovered that the polynuclear aromatic compounds which are primarily responsible for the fouling problems associated with the high conversion of hydrocarbon feedstock in a hydrocracking zone possess 11+ aromatic rings. Therefore, it becomes highly desirable to minimize the concentration of 11+ ring heavy polynuclear aromatic compounds (HPNA) which are recycled to the hydrocracking reaction zone in order to ensure trouble free operation and long run length.

In some cases where the concentration of 11+ ring heavy polynuclear aromatic compounds (HPNA) foulants is small, the amount of unconverted hydrocarbon stream condensed and contacted with the adsorbent may be reduced in order to maintain the 11+ ring heavy polynuclear aromatic compounds at concentration levels below that which promote precipitation and subsequent plating out on heat exchanger surfaces. The expression "trace quantities of 11+ ring heavy polynuclear aromatic compounds" as used herein is preferably described as a concentration of less than about 10,000 parts per million (PPM) and more preferably less than about 5,000 PPM.

The hydrocarbonaceous feed stock subject to processing in accordance with the process of the present invention preferably comprises a component selected from the group consisting of a vacuum gas oil, light cycle oil, heavy cycle oil, demetallized oil and coker gas oil. Preferred hydrocarbonaceous feedstocks boil at a temperature greater than about 650° F. (343° C.)

The selected feedstock is introduced into a hydrocracking zone. Preferably, the hydrocracking zone contains a catalyst which comprises in general any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves, and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters) It is preferred to employ zeolites having a relatively high silica/alumina mole ratio between about 3 and 12, and even more preferably between about 4 and 8. Suitable zeolites found in nature include for example mordenite, stilbite, heulandite, ferrierite, dachiardite, chabazite, erionite and faujasite. Suitable synthetic zeolites include for example the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in this preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metal employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about 450° F. (232° C.) to about 850° F. (454° C.), a pressure from about 500 psig (3448 kPa gauge) to about 3000 psig (20685 kPa gauge), a liquid hourly space velocity (LHSV) from about 0.2 to about 20 $hr.^{-1}$, and a hydrogen circulation rate from about 2000 (337 normal $m^3/m^3$) to about 15,000 (2528 normal $m^3/m^3$) standard cubic feet per barrel.

In accordance with the present invention, the resulting effluent from the hydrocracking catalyst zone is partially condensed to provide a heavy hydrocarbonaceous liquid fraction containing 11+ ring heavy polynuclear aromatic compounds as well as unconverted feedstock components and a lower boiling fraction containing hydrocarbonaceous products. The lower boiling fraction is subsequently introduced into a separation zone such as a fractionation zone, for example, to produce desired product streams such as, gasoline, kerosene and diesel fuel, for example. The heavy hydrocarbonaceous liquid fraction containing 11+ ring heavy polynuclear aromatic compounds is contacted with an adsorbent which selectively retains the 11+ ring heavy polynuclear aromatic compounds to thereby selectively reduce the concentration of 11+ ring heavy polynuclear aromatic compounds. In a preferred embodiment of the present invention, the concentration of 11+ ring heavy polynuclear aromatic compounds in the effluent from the adsorbent is essentially zero. The volume of the heavy hydrocarbonaceous liquid fraction containing 11+ ring heavy polynuclear aromatic compounds produced and contacted with the adsorbent is preferably controlled by the temperature of the partial condensation and this temperature is preferably maintained in the range from about 300° F. (149° C.) to about 750° F. (400° C.).

Generally, the effluent from the hydrocracking catalyst zone is most conveniently condensed in a series of heat exchangers which do not possess the flexibility to widely adjust the temperature of the condensing effluent from the hydrocracking zone thereby producing a partially condensed stream containing a hydrocarbon liquid containing both unconverted feedstock components as well as hydrocarbon products. Such hydrocarbon liquid is not totally suitable for direct recycle to the hydrocracking reaction zone because some of the hydrocarbon products may be further hydrocracked which is unnecessary and undesirable. In order to obviate this problem without building a complicated and expensive heat exchanger system, I have discovered the herein described process.

A portion of the resulting heavy hydrocarbonaceous liquid fraction containing a substantially reduced concentration of 11+ ring heavy polynuclear aromatic compounds after contacting the adsorbent is directly recycled to the hydrocracking zone to produce lower boiling hydrocarbon products and another portion is introduced into the hereinabove mentioned separation zone to produce desired product streams and an unconverted hydrocarbonaceous stream which is included as a portion of the recycle stream to the hydrocracking zone.

The portion of the resulting heavy hydrocarbonaceous liquid fraction containing a substantially reduced concentration of 11+ ring heavy polynuclear aromatic compounds after contacting the adsorbent which is ultimately introduced into the separation zone may be directly introduced into the separation zone or at least a portion thereof may be cooled prior to the introduction into the separation zone in order to achieve the proper heat input for the separation zone.

The lower boiling fraction containing hydrocarbonaceous products resulting from the hereinabove described partial condensation is subjected to further condensation to produce a hydrogen-rich gaseous stream and a liquid hydrocarbon stream containing hydrocarbon products. The resulting liquid hydrocarbon stream containing hydrocarbon products is preferably separated to provide desired streams such as, gasoline, kerosene and diesel fuel, for example. The unconverted feedstock components recovered in the separation zone preferably boil at a temperature greater than about 400° F. (204° C.) and are recycled to the hydrocracking zone.

In accordance with the present invention, suitable adsorbents may be selected from materials which exhibit the primary requirement of 11+ ring heavy polynuclear aromatic compound selectivity and which are otherwise convenient and economical to use. Suitable adsorbents include, for example, molecular sieves, silica gel, activated carbon, activated alumina, silica-alumina gel, clays and admixtures thereof. Of course, it is recognized that for a given case, a particular adsorbent may give better results than others.

The selected adsorbent is contacted with the heavy hydrocarbonaceous liquid fraction containing trace quantities of 11+ ring heavy polynuclear aromatic compounds as well as unconverted feedstock components in an adsorption zone. The adsorbent may be installed in the adsorption zone in any suitable manner. A preferred method for the installation of the adsorbent is in a fixed bed arrangement. The adsorbent may be installed in one or more vessels and in either series or parallel flow. The flow of hydrocarbons through the adsorption zone is preferably performed in a parallel manner so that when one of the adsorbent beds or chambers is spent by the accumulation of 11+ ring heavy polynuclear aromatic compounds thereon, the spent zone may be bypassed while continuing uninterrupted operation through the parallel zone. The spent zone of adsorbent may then be regenerated or the spent adsorbent may be replaced as desired.

The adsorption zone is preferably maintained at a pressure from about 10 psig (69 kPa gauge) to about 3000 psig (20685 kPa gauge), a temperature from about 50° F. (10° C.) to about 750° F. (400° C.) and a liquid hourly space velocity from about 0.01 to about 500 $hr^{-1}$. The flow of the hydrocarbons through the adsorption zone may be conducted in an upflow, downflow or radial flow manner. The temperature and pressure of the adsorption zone are preferably selected to maintain the hydrocarbons in the liquid phase. At least a portion of the resulting heavy hydrocarbonaceous liquid fraction having a substantially reduced concentration of 11+ ring heavy polynuclear aromatic compounds is then recycled to the hydrocracking zone for further processing and subsequent conversion to lower boiling hydrocarbons and at least a portion is introduced into a separation zone to produce desired product streams and an unconverted feedstock stream which is included as a portion of the recycle stream to the hydrocracking zone.

In accordance with the present invention, the heavy hydrocarbonaceous liquid fraction and containing trace quantities of 11+ ring heavy polynuclear aromatic compounds which is produced by partially condensing the effluent from the hydrocracking zone is preferably from about 20 volume percent to about 104 volume percent of the hydrocarbonaceous feedstock.

In the drawing, a preferred embodiment of the present invention is illustrated by means of a simplified flow diagram in which such details as pumps, instrumentation, heat exchange and heat-recovery circuits, compressors and similar hardware have been deleted as being non-essential to an understanding of the techniques involved. The use of such miscellaneous appurtenances are well within the purview of one skilled in the art.

DESCRIPTION OF THE DRAWING

With reference now to the drawing, a vacuum gas oil feed stream having a propensity to form 11+ ring heavy polynuclear aromatic compounds is introduced into the process via conduit 1 and admixed with a hydrogen-rich gaseous stream provided by conduit 8 and an unconverted hydrocarbon liquid recycle stream provided via conduit 13. The resulting admixture is then introduced via conduit 1 into hydrocracking zone 2. The resulting effluent containing conversion products, unconverted hydrocarbons and trace quantities of 11+ ring heavy polynuclear aromatic compounds is removed from hydrocracking zone 2 via conduit 3 and introduced into heat exchanger 4 for cooling and to provide a partial condensation of the hydrocracking zone effluent.

The effluent from heat exchanger 4 is transported via conduit 3 and introduced into vapor-liquid separator 17. A gaseous hydrocarbon stream comprising hydrogen is removed from vapor-liquid separator 17 via conduit 5 and introduced into heat exchanger 6 for cooling and to provide for partial condensation. The two-phase effluent from heat exchanger 6 is transported via conduit 5 and introduced into vapor-liquid separator 7. A hydrogen-rich gaseous stream is removed from vapor-liquid separator 7 via conduit 8, is admixed with make-up hydrogen provided via conduit 23 and the resulting admixture is introduced into hydrocracking zone 2 via conduit 8 and conduit 1. Since hydrogen is lost in the process by means of a portion of the hydrogen being dissolved in a hereinafter-described exiting liquid hydrocarbon, and hydrogen being consumed during the hydrocracking reaction, it is necessary to supplement the hydrogen-rich gaseous stream with make-up hydrogen from some suitable external source, for example, a catalytic reforming unit or a hydrogen plant. A liquid stream containing lower boiling hydrocarbon products and unconverted hydrocarbonaceous compounds boiling above about 400° F. (204° C.) is removed from vapor-liquid separator 7 via conduit 9 and is introduced into product fractionation zone 10. A product stream containing normally gaseous hydrocarbons and low boiling normally-liquid hydrocarbons is removed from product fractionation zone 10 via conduit 11 and recovered. A somewhat heavier hydrocarbon product stream is removed from product fractionation zone 10 via conduit 12 and recovered. An unconverted hydrocarbonaceous stream is removed from the bottom of product fractionation zone 10 via conduit 13 and is introduced into hydrocracking zone 2 via conduits 13 and 1 as a portion of the recycle stream. A heavy hydrocarbonaceous liquid fraction containing 11+ ring heavy polynuclear aromatic compounds is removed from vapor-liquid separator 17 via conduit 14 and introduced into adsorption zone 15 which contains an adsorbent selected to retain 11+ ring heavy polynuclear aromatic compounds. A heavy hydrocarbonaceous liquid stream having a substantially reduced concentration of 11+ ring heavy polynuclear aromatic compounds is removed from adsorption zone 15 via conduit 16 and at least a portion thereof is introduced into hydrocracking zone 2 via conduits 16, 13 and 1 as another portion of the recycle stream. At least another portion of the heavy hydrocarbonaceous liquid stream having a reduced concentration of 11+ ring heavy polynuclear aromatic compounds is removed from adsorption zone 15 via conduit 16 and ultimately introduced into product fractionation zone 10 without first passing through hydrocracking zone 2.

In one embodiment of the present invention, a portion of the heavy hydrocarbonaceous liquid stream removed from adsorption zone 15 is transported via conduits 16, 18, 21 and 9 to be introduced into product fractionation zone 10. Valve 22 is included in conduit 21 to control the flow rate.

In another embodiment of the present invention, a portion of the heavy hydrocarbonaceous liquid stream removed from adsorption zone 15 is transported via conduits 16, 18, 19, 5, heat exchanger 6, vapor liquid separator 7 and conduit 9 to be introduced into product fractionation zone 10. Valve 20 is included in conduit 19 to control the flow rate.

The process of the present invention is further demonstrated by the following illustrative embodiments. These illustrative embodiments are however not presented to unduly limit the process of this invention, but to further illustrate the advantages of the hereinabove described embodiments. The following data were not obtained by the actual performance of the present invention, but are considered prospective and reasonably illustrative of the expected performance of the invention.

ILLUSTRATIVE EMBODIMENT 1

A hydrocracker having a first bed of hydrocracking catalyst containing alumina, silica, nickel and tungsten followed in series by a second bed of hydrocracking catalyst containing alumina, crystalline aluminosilicate, nickel and tungsten is operated in a high conversion mode with a feedstock having the characteristics presented in Table 1. The crystalline aluminosilicate present in the latter catalyst is Y zeolite. The fresh feedstock contains 0 wppm 11+ ring heavy aromatic compounds. Virgin hydrocarbonaceous feedstocks are generally considered by artisans to contain no detectable heavy polynuclear aromatic compounds. The effluent from the second bed of hydrocracking catalyst is sampled and found to contain 10 weight ppm of 11+ ring heavy polynuclear aromatic compounds. This effluent from the second bed of hydrocracking catalyst is partially condensed at a temperature of 700° F. (371° C.) and a pressure of 2000 psig (13790 kPa gauge) to provide an unconverted hydrocarbon stream boiling above about 400° F. (204° C.) and containing 26 wppm of 11+ ring heavy polynuclear aromatic compounds. This unconverted hydrocarbon stream is about 52 volume percent of the volume of the fresh feedstock and is contacted with an activated charcoal bed in an adsorption zone which effectively adsorbs all detectable quantities of 11+ ring heavy polynuclear aromatic compounds. Thirty volume percent of the effluent from the adsorption zone containing unconverted hydrocarbons (16 volume percent of the volume of the fresh feedstock) is recycled to the first bed of hydrocracking catalyst. The remainder of the effluent from the adsorption zone (36 volume percent of the volume of the fresh feedstock) is cooled in a heat exchanger which is in the hydrocracking zone effluent circuit and introduced into the fractionation zone described below. The previously non-condensed effluent from the second bed of hydrocracking catalyst is subjected to a second partial condensation at a temperature of about 100° F. (38° C.) to provide a liquid hydrocarbonaceous stream and a hydrogen-rich gaseous stream which is recycled, along with make-up hydrogen, to the first bed of hydrocracking catalyst. The liquid hydrocarbonaceous stream resulting from the second partial condensation is separated in a fractionation zone into lower boiling hydrocarbon products including gasoline kerosene and diesel, and a bottoms stream of unconverted hydrocarbonaceous compounds boiling above about 400° F. (204° C.). This resulting bottoms stream of unconverted hydrocarbonaceous compounds from the fractionation zone is about 29 volume percent of the volume of the fresh feedstock and is recycled to the first bed of hydrocracking catalyst along with the previously described portion of the effluent from the adsorption zone.

This hydrocracker is operated for an extended period of time without any significant deposition of 11+ ring heavy polynuclear aromatic compounds on the heat exchange surfaces of the physical plant and demonstrates enhanced hydrocracking catalyst life due to a minimization of coke laydown attributed to the present invention.

A survey of the pertinent liquid hydrocarbon streams is made to determine the concentration of 11+ ring heavy polynuclear aromatic compounds and the results are summarized and presented in Table 2.

TABLE 1

| HYDROCRAKER FEEDSTOCK ANALYSIS | |
|---|---|
| Specific Gravity/API Gravity | 0.9001/25.7 |
| Distillation, Volume Percent | |
| IBP, °F (°C.) | 690 (366) |
| 10 | 760 (404) |
| 30 | 800 (426) |
| 50 | 830 (443) |
| 70 | 868 (464) |
| 90 | 920 (493) |
| End Point, Recovery 98% | 1007 (542) |

11+ Ring Heavy Aromatic Compounds, wppm 0

TABLE 2

11+ RING HEAVY POLYNUCLEAR AROMATIC COMPOUND SURVEY

| Stream | 11+ Ring Heavy Polynuclear Aromatic Compound Concentration, WPPM |
|---|---|
| 2nd Catalyst Bed Liquid Effluent | 10 |
| Hydrocarbon to Adsorption Zone | 26 |
| Hydrocarbon from Adsorption Zone | 0 |
| Fractionation Bottoms Stream | 0 |
| Combined Liquid Recycle | 0 |

ILLUSTRATIVE EMBODIMENT 2

A hydrocracker having a first bed of hydrocracking catalyst containing alumina, silica, nickel and tungsten followed in series by a second bed of hydrocracking catalyst containing alumina, crystalline aluminosilicate, nickel and tungsten is operated in a high conversion mode with a feedstock having the characteristics presented in Table 3. The crystalline aluminosilicate present in the latter catalyst is Y zeolite. The fresh feedstock contains 0 wppm 11+ ring heavy aromatic compounds. Virgin hydrocarbonaceous feedstocks are generally considered by artisans to contain no detectable heavy polynuclear aromatic compounds. The effluent from the second bed of hydrocracking catalyst is sampled and found to contain 10 weight ppm of 11+ ring heavy polynuclear aromatic compounds. This effluent from the second bed of hydrocracking catalyst is partially condensed at a temperature of 350° F. (177° C.) and a pressure of 2000 psig (13790 kpa gauge) to provide a heavy hydrocarbonaceous liquid fraction and containing 13 wppm of 11+ ring heavy polynuclear aromatic compounds. This heavy hydrocarbonaceous liquid fraction is about 104 volume percent of the volume of the fresh feedstock and is contacted with an activated charcoal bed in an adsorption zone which effectively adsorbs all detectable quantities of 11+ ring heavy polynuclear aromatic compounds. During hydrocracking, the volume of liquid products increases over the volume of original fresh feedstock due to the uptake or reaction of hydrogen with the liquid hydrocarbon compounds. Twenty-five volume percent of the effluent from the adsorption zone (39 volume percent of the volume of the fresh feedstock) is recycled to the first bed of hydrocracking catalyst. The remainder of the effluent from the adsorption zone (65 volume percent of the volume of the fresh feedstock) is introduced into the fractionation zone described below. The previously noncondensed effluent from the second bed of hydrocracking catalyst is subjected to a second partial condensation at a temperature of about 100° F. (38° C.) to provide a liquid hydrocarbonaceous stream and a hydrogen-rich gaseous stream which is recycled, along with make-up hydrogen, to the first bed of hydrocracking catalyst. The liquid hydrocarbonaceous stream resulting from the second partial condensation is separated in a fractionation zone into lower boiling hydrocarbon products including gasoline, kerosene and diesel, and a bottoms stream of unconverted hydrocarbonaceous compounds boiling above about 400° F. (204° C.). This resulting bottoms stream of unconverted hydrocarbonaceous compounds from the fractionation zone is about 38 volume percent of the volume of the fresh feedstock and is recycled to the first bed of hydrocracking catalyst along with the previously described portion of the effluent from the adsorption zone.

This hydrocracker is operated for an extended period of time without any significant deposition of 11+ ring heavy polynuclear aromatic compounds on the heat exchange surfaces of the physical plant and demonstrates enhanced hydrocracking catalyst life due to a minimization of coke laydown attributed to the present invention.

A survey of the pertinent liquid hydrocarbon streams is made to determine the concentration of 11+ ring heavy polynuclear aromatic compounds and the results are summarized and presented in Table 4.

TABLE 3

| HYDROCRACKER FEEDSTOCK ANALYSIS | |
|---|---|
| Specific Gravity/API Gravity | 0.9001/25.7 |
| Distillation, Volume Percent | |
| IBP, °F (°C.) | 690 (366) |
| 10 | 760 (404) |
| 30 | 800 (426) |
| 50 | 830 (443) |
| 70 | 868 (464) |
| 90 | 920 (493) |
| End Point, Recovery 98% | 1007 (542) |

11+ Ring Heavy Aromatic Compounds, wppm 0

TABLE 4

| 11+ RING HEAVY POLYNUCLEAR AROMATIC COMPOUND SURVEY | |
|---|---|
| Stream | 11+ Ring Heavy Polynuclear Aromatic Compound Concentration, WPPM |
| 2nd Catalyst Bed Liquid Effluent | 10 |
| Hydrocarbon to Adsorption Zone | 13 |
| Hydrocarbon from Adsorption Zone | 0 |
| Fractionation Bottoms Stream | 0 |
| Combined Liquid Recycle | 0 |

The foregoing description, drawing and illustrative embodiments clearly illustrate the advantages encompassed by the process of the present invention and the benefits to be afforded with the use thereof.

What is claimed is:

1. A catalytic hydrocracking process which comprises:

(a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to convert a substantial portion of said feedstock to lower boiling hydrocarbon products;

(b) partially condensing the hydrocarbon effluent from said hydrocracking zone to produce a gaseous hydrocarbon stream comprising hydrogen, and an unconverted hydrocarbon stream having components boiling above about 400° F. and comprising trace quantities of 11+ ring heavy polynuclear aromatic compounds;

(c) partially condensing at least a portion of said gaseous hydrocarbon stream comprising hydrogen recovered in step (b) to produce a hydrogen-rich gaseous stream and a liquid stream comprising lower boiling hydrocarbon products;

(d) contacting at least a portion of said unconverted hydrocarbon stream having components boiling above about 400° F. and comprising trace quantities of 11+ ring heavy polynuclear aromatic compounds recovered in step (b) with an adsorbent in an adsorption zone which selectively retains said 11+ ring heavy polynuclear aromatic compounds to produce an unconverted hydrocarbon stream having components boiling above about 400° F. and having a reduced concentration of 11+ ring heavy polynuclear aromatic compounds;

(e) introducing at least a portion of said unconverted hydrocarbon stream having components boiling above about 400° F. and having a reduced concentration of 11+ ring heavy polynuclear aromatic compounds resulting from step (d) and said liquid stream recovered from step (c) into a separation zone to produce a stream of lower boiling hydrocarbon products and a stream of unconverted hydrocarbonaceous compounds boiling above about 400° F.; and (f) recycling at least a portion of said stream of unconverted hydrocarbonaceous compounds boiling above about 400° F. recovered in step (e) and at least a portion of said unconverted hydrocarbon stream having components boiling above about 400° F. and having a reduced concentration of 11+ ring heavy polynuclear aromatic compounds resulting from step (d) to said hydrocracking zone as at least a portion of said liquid recycle stream.

2. The process of claim 1 wherein at least a portion of said unconverted hydrocarbon stream having components boiling above about 400° F. and having a reduced concentration of 11+ ring heavy polynuclear aromatic compounds produced in step (d) is cooled prior to the introduction into the separation zone of step (e).

3. The process of claim 1 wherein said hydrocracking zone is maintained at a pressure from about 500 psig to about 3000 psig.

4. The process of claim 1 wherein said hydrocracking zone is maintained at a temperature from about 450° F. to about 850° F.

5. The process of claim 1 wherein said metal promoted hydrocracking catalyst comprises synthetic faujasite.

6. The process of claim 1 wherein said metal promoted hydrocracking catalyst comprises nickel and tungsten.

7. The process of claim 1 wherein said hydrocarbonaceous feedstock boils at a temperature greater than about 650° F.

8. The process of claim 1 wherein said adsorption zone is operated at conditions which include a temperature from about 50° F. to about 750° F., a pressure from about 10 psig to about 3000 psig, and a liquid hourly space velocity from about 0.01 to about 500 $hr^{-1}$.

9. The process of claim 1 wherein said adsorbent is selected from the group consisting of silica gel, activated carbon, activated alumina, silica-alumina gel, clay, molecular sieves and admixtures thereof.

10. The process of claim 1 wherein said hydrocarbonaceous feedstock having a propensity to form 11+ ring heavy polynuclear aromatic compounds comprises a component selected from the group consisting of vacuum gas oil, light cycle oil, heavy cycle oil, demetallized oil and coker gas oil.

11. The process of claim 1 wherein step (b) is conducted at a temperature in the range from about 300° F. to about 750° F.

12. The process of claim 1 wherein said unconverted hydrocarbon stream having components boiling above about 400° F. and comprising trace quantities of 11+ ring heavy polynuclear aromatic compounds produced in step (b) is from about 20 to about 104 volume percent of said hydrocarbonaceous feedstock.

* * * * *